United States Patent [19]

Gaia

[11] 4,375,630

[45] Mar. 1, 1983

[54] MULTIPLE ELEMENT CURRENT LIMITING FUSE

[75] Inventor: Aldino J. Gaia, St. Louis, Mo.

[73] Assignee: McGraw-Edison Company, Rolling Meadows, Ill.

[21] Appl. No.: 250,096

[22] Filed: Apr. 1, 1981

[51] Int. Cl.[3] ..... H01H 37/04

[52] U.S. Cl. ..... 337/248; 337/252

[58] Field of Search ..... 337/227, 228, 229, 231, 337/237, 246, 247, 248, 251, 252

[56] References Cited

U.S. PATENT DOCUMENTS 2,713,098 7/1955 Swain ..... 337/246 X 3,342,962 9/1967 Kozacka ..... 337/247

*Primary Examiner*—George Harris

*Attorney, Agent, or Firm*—Charles W. MacKinnon; Ronald J. LaPorte; Jon Gealow

[57] ABSTRACT

A multiple element current limiting fuse has a plurality of tube fuses soldered at opposite ends to a pair of metallic end bells having blade-like terminals for connection to busbars of an external electrical circuit. Fasteners having the general dimensions of the tube fuses are also mounted between the end bells and connectors, such as, studs or rivets are formed on ferrules at opposite ends of the fasteners to mechanically couple the fasteners to the end bells and preserve the spacing between the end bells even when the fuse is subjected to tensile forces and elevated temperatures efficient to soften the solder. The use of a hollow ceramic body and hollow connectors at the ends of the fasteners permits the passage of coolant through the fasteners for cooling the multiple element fuse.

8 Claims, 6 Drawing Figures

MULTIPLE ELEMENT CURRENT LIMITING FUSE

BACKGROUND OF THE INVENTION

1. Field of the Invention

This invention relates to a multiple element fuse and in particular a multiple element fuse of open construction wherein each fusible element is mounted within an insulative tube.

2. DESCRIPTION OF THE PRIOR ART

Prior art multiple element fuses often include a plurality of fusible elements each mounted within an insulative tube. Fusible elements mounted in this fashion are commonly referred to as "tube fuses". Such multiple element fuses conventionally have end bells soldered at opposite ends of the tube fuses, the tube fuses being exposed therebetween. Devices of this type are designed to operate near their current carrying capacity, and require an open construction to allow greater air cooling of the individual tube fuses. It is frequently desirable to provide air flow through the interior of the fuse, or to otherwise provide a forced cooling of the tube fuses with a fluid medium.

A blade terminal typically is formed with or joined to the end bells of the multiple element fuses for connection with bolts or similar fasteners to elongated busbars of electrical equipment. Frequently, the busbars are not spaced apart to the exact distance required to achieve alignment with mounting holes located in the blade terminals of the multiple element fuses. As such, one or both of the busbars must be deflected to provide alignment with the blade terminals, to allow a bolted connection to be made therebetween. This frequently imposes tensile forces on the multiple element fuse end bells. As such, when the fuse operates to clear an electrical overload, the soldered connection between the end bells and the tube fuses sometimes weakens or melts sufficiently to allow the busbars to resume their rest position, thus pulling the fuse apart, causing the individual tube fuses to fall away possibly into the switch gear within which the fuse is installed.

SUMMARY OF THE INVENTION

Accordingly, it is an object of the present invention to provide a new and improved multiple element fuse comprising a plurality of tube fuses joined at the ends thereof to end bells designed for connection to spaced busbars, which fuse remains mechanically intact subsequent to the operation of the fuse to clear an electrical overload despite the application of tensile forces applied to the end bells thereof.

It is another object of this invention to provide a multiple element fuse of the above-described type which is relatively inexpensive to fabricate, simple in design yet is effective in use.

The foregoing objects are accomplished in accordance with the present invention, in one form thereof, by providing a multiple element fuse comprising spaced apart end bells having blade-like terminals for connection to busbars of an external electrical circuit. A plurality of tube fuses are soldered at opposite ends to the metallic end bells, respectively, to provide mechanical and electrical connection between the fuses and end bells. Fasteners having the general dimensions of the tube fuses, but including a ceramic insulating body are also mounted between the end bells. Connectors, such as, for example, rivets, threaded studs, or the like formed on ferrules at opposite ends of the fasteners, are employed to mechanically couple the fasteners to the end bells. Such fasteners preserve the spacing between the end bells even when the fuse is subjected to tensile forces. The use of a hollow ceramic body and hollow connectors at the ends of the fasteners permits the passage of coolant through the fasteners for cooling the multiple element fuse, if desired.

DETAILED DESCRIPTION OF THE PREFERRED EMBODIMENT

Figure 1:
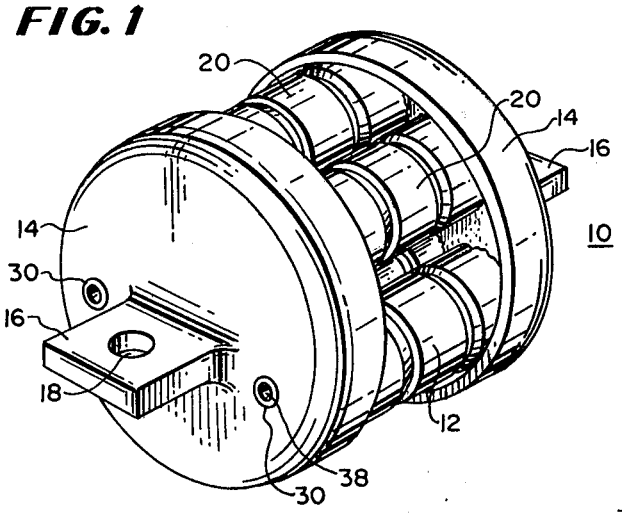
FIG. 1 is a perspective view of an assembled multiple element fuse including fasteners according to the invention.
Figure 2:
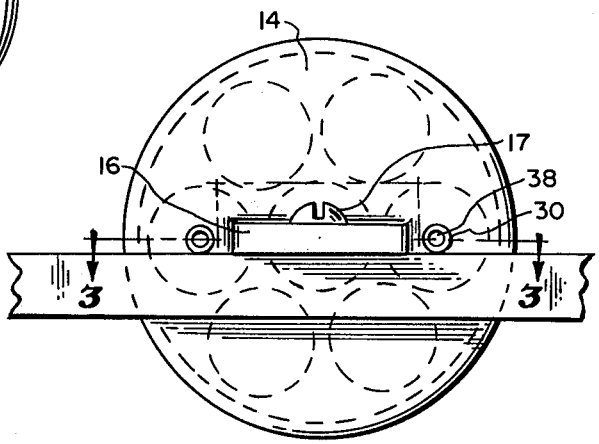
FIG. 2 is an end view of the multiple element fuse of FIG. 1, the fuse being shown installed between a pair of busbars.
Figure 3:
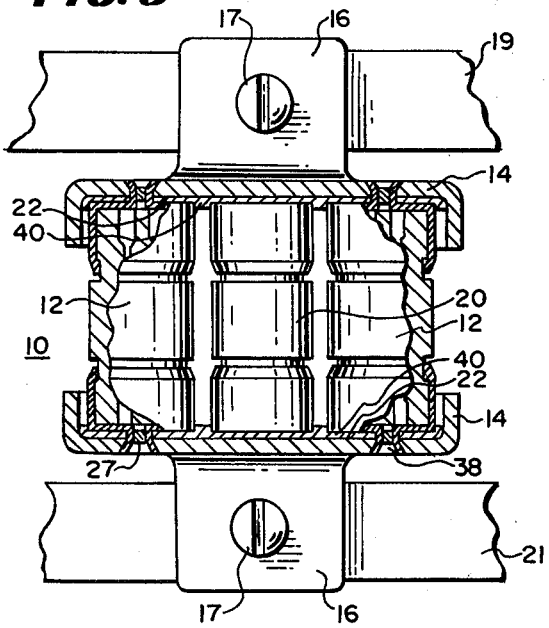
FIG. 3 is a side sectional view of the multiple element fuse of FIG. 2 taken along lines 3—3 thereof.

Referring now to the drawing in greater detail wherein like numerals have been employed throughout the various views to designate similar components, FIGS. 1-3 illustrate a multiple element fuse 10 according to the invention. Multiple element fuse 10 comprises a pair of metallic end bells 14 and a plurality of current carrying fusible elements, herein illustrated as cylindrically shaped tube fuses, each designated by the numeral 20. The ends of the tube fuses are joined by solder 40 (FIG. 3) to the inside surface 22 of metallic end bells 14.

Also connected between metallic end bells 14 are a pair of fasteners 12 having the same general dimensions as tube fuses 20. The purpose of fasteners 12 as described heretofore is to maintain multiple element fuse 10 intact under virtually all conditions. As will be described in greater detail hereinafter, fasteners 12 remain joined to end bells 14 even after high temperature clearing of the tube fuses 20, thereby preserving the spacing between the end bells despite forces applied thereto by busbars 19, 21. Metallic end bells 14 are each provided with a blade-like terminal 16 for connection to the spaced apart electrical busbars, such as, for example, by bolts or the like fasteners 17 which are inserted into mounting holes 18 of terminals 16 and into busbars 19, 21 in a conventional manner (see FIG. 3).

Figure 4:
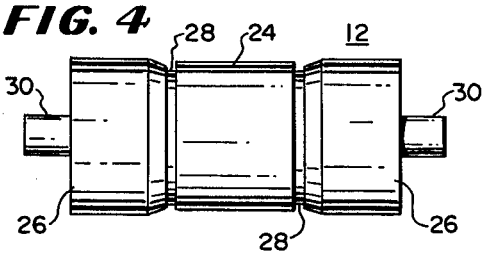
FIG. 4 is an enlarged side view of a fastener of the multiple element fuse of FIG. 1.
Figure 5:
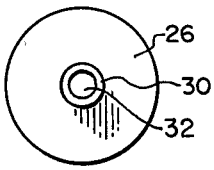
FIG. 5 is an end view of the fastener of FIG. 4.
Figure 6:
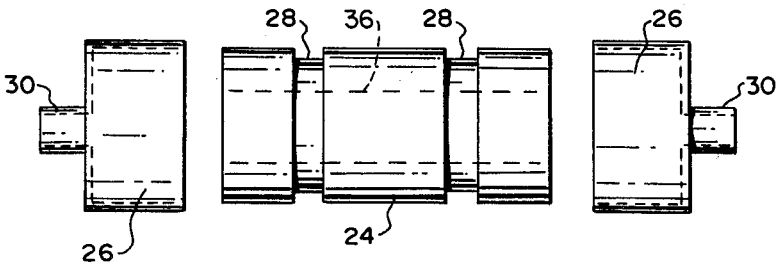
FIG. 6 is an exploded view of the fastener of FIG. 4.

A fastener 12 is shown in detail in FIGS. 4-6 of the drawing. A completely assembled fastener 12 illustrated in FIG. 4 includes a tubular body 24 of porcelain or other insulating material and metallic ferrules 26 provided at opposite ends thereof. Ferrules 26 are telescoped over each end of body 24, and are crimped for engagement with circumferential grooves 28 formed in body 24. The ferrules 26 have hollow studs or other mounting means 30 for receipt in holes 38 formed in end bells 14. Rivets, bolts, or similar means 27 (FIG. 3) may be received in end bells 14 and studs 30 of ferrules 26 to mechanically couple the fastener to the end bells.

Multiple element fuse 10 shown in FIGS. 1-3 is constructed by placing the plurality of tube fuses 20 and a pair of fasteners 12 between end bells 14 arranged as illustrated. Hollow studs 30 of the fasteners 12 are received in countersunk holes 38 defined in end bells 14, and may be secured thereto by flaring studs 30 to form fit countersunk holes 38 or as described heretofore by bolts, rivets or the like 27 or by both such means. Solder 40 is then applied to the inside surface 22 of each end bell 14 to electrically and mechanically connect the end bells and the adjacent ends of tube fuses 20.

The preferred embodiment of multiple element fuse 10 illustrated in the drawing includes disc shaped end bells 14 having a diameter of a predetermined length. Fasteners 12 are spaced at 180 degrees apart near the periphery of end bells 14. Tube fuses 20 are interposed between fasteners 12 along the periphery and at the center of end bells 14.

Multiple element fuses are typically operated at or near their rated capacity, and require an open construction wherein an outer casing between the end bells is omitted, thereby to provide enhanced cooling for the plurality of tube fuses. Blade terminals 16 of the multiple element fuse provide the large contact area necessary for electrically connecting high capacity fuses of this type into an electrical circuit. As described, the blade terminals are typically bolted to busbars located in switch gear or other similar electrical devices. Any minor adjustments to the spacing between the busbars is usually made by bending them to provide alignment with mounting holes 18 of terminal 16, to allow insertion of the bolt 17 or other fastening means therethrough. If the busbars are spaced too close together, a compressive force is applied to the end bells 14 after fuse 10 is installed. In this case no unusual problems should occur upon fuse clearing. On the other hand if the busbars are spaced too far apart and must be urged together to allow installation of fuse 10, tensile forces are thereafter applied to end bells 14. In the latter case, upon fuse clearing, sufficient heat may be generated to weaken or melt solder 40, breaking the mechanical connection of tube fuses 20 with the end bells 14. Since no outer casing is present to maintain fuse 10 intact, tube fuses 20 would normally be free to drop out, often into the switch gear or other electrical devices in the vicinity, possibly causing damage thereto.

Fasteners 12 included in the multiple element fuse of the present invention provide an effective means of securing end bells 14 together at all times, thereby maintaining tube fuses 20 in place within fuse 10 even if the internal solder connections should weaken sufficiently to break the mechanical connection to the tube fuses.

To further enhance the operation of the high capacity multiple element fuse 10, mounting means 30 of fasteners 12 may be provided with a central opening 32. Being tubular, insulating ceramic body 24 of fastener 12 has a central hollow portion 36 and hence can serve as a conduit for the passage of fluid coolant therethrough. Once fuse 10 is installed, fluid connections may be made to the ends of mounting means 30, such as, for example, by copper or plastic tubing to carry fluid coolant from a remote source to multiple element fuse 10. This capability is particularly advantageous for very high current capacity fuses which are continuously operated very near their rated capacity.

Thus, it can be seen that the multiple element fuse including fasteners according to the invention remains intact even in the event that tensile forces are applied thereto, in the presence of an elevated temperature. Furthermore, the construction of the multiple element fuse of this invention lends itself to fluid cooling thereof, if desired, in an efficient and convenient manner.

I claim:

1. A multiple element, current-limiting fuse comprising:

at least two spaced-apart metallic end bells each having an interior surface and means for connection to an external electrical circuit;

a plurality of fusible elements disposed between said end bells and connected to said interior surfaces thereof by means of a heat softenable alloy;

fastener means disposed between said end bells, said fastener means including a central body formed of electrical insulative material, said body having first and second ends, and first and second metallic ferrules connected to said first and second ends of said central insulative body, respectively;

and connecting means for mechanically coupling said ferrules to said end bells, said fastener means securing said end bells in fixed spaced-apart relationship even upon the application of opposing forces to said end bells in the presence of an elevated temperature sufficient to weaken said heat softenable alloy, said connecting means includes studs and said end bells define apertures dimensioned for receipt of said studs.

2. The fuse as claimed in claim 1 wherein said fuse includes first and second fastener means mounted in spaced relation with respect to each other between said end bells.

3. The fuse as claimed in claim 2 wherein said end bells are circular, wherein said fusible elements are each mounted within a cylindrically shaped insulative tube, and wherein said fastener means are cylindrically shaped and are spaced 180 degrees about the periphery of said end bells.

4. The fuse as claimed in claim 1 wherein said insulative body of said fastener means is formed of a ceramic material and defines grooves therein for crimp connection of said metallic ferrules to said body.

5. The fuse of claim 1 wherein said fusible elements of said fasteners are of approximately the same dimension and configuration.

6. The fuse of claim 1 wherein said central insulative body of said fastener means is hollow and wherein said connecting means for mechanically coupling said ferrules to said end bells defines an opening to receive fluid coolant for passage of said coolant through said insulative body.

7. A multiple element, current-limiting fuse comprising:

at least two spaced-apart, disc shaped metallic end bells each having an interior surface and terminal means for connection to an external electrical circuit;

a plurality of fusible elements each mounted within a cylindrically shaped insulative tube, and disposed between said end bells and connected to said interior surfaces thereof, by means of a heat softenable alloy;

first and second fastener means disposed between said end bells, each of said fastener means including a cylindrically shaped central body formed of insulative material, said body having first and second ends, and first and second metallic ferrules connected to said first and second ends of said central insulative body, respectively, said fusible elements and said first and second fastener means being of approximately the same dimension and configuration, said first and second fastener means being mounted 180 degrees apart adjacent the periphery of said end bells, certain ones of said plurality of said fusible elements also being mounted adjacent the periphery of said end bells and at least one other of said fusible elements being mounted centrally of said end bells; and mechanical connecting means for coupling said metallic ferrules to said end bells, respectively, said mechanical connecting means maintaining said end bells in fixed, spaced-apart relationship even upon the application of opposing forces to said end bells in the presence of an elevated temperature sufficient to weaken said heat softenable alloy, said end bells define predetermindly dimensioned apertures and wherein said connecting means comprise studs extending from said ferrules, said studs dimensioned for receipt in said apertures defined in said end bells for mechanically coupling said ferrules to said end bells.

8. The fuse of claim 7 wherein said central insulative body of each said fastener means is hollow and wherein said connecting means for mechanically coupling said ferrules to said end bells defines an opening to receive fluid coolant for passage of said coolant through said insulative body.

* * * * *